US010256061B2

(12) United States Patent
Neumann

(10) Patent No.: US 10,256,061 B2
(45) Date of Patent: Apr. 9, 2019

(54) TEMPERATURE-DEPENDENT SWITCHING MECHANISM

(71) Applicant: Thermik Geraetebau GmbH, Sondershausen (DE)

(72) Inventor: René Neumann, Badra (DE)

(73) Assignee: THERMIK GERAETEBAU GMBH, Sondershausen (DE)

( * ) Notice: Subject to any disclaimer, the term of this patent is extended or adjusted under 35 U.S.C. 154(b) by 615 days.

(21) Appl. No.: 14/513,259

(22) Filed: Oct. 14, 2014

(65) Prior Publication Data

US 2015/0109092 A1 Apr. 23, 2015

(30) Foreign Application Priority Data

Oct. 17, 2013 (DE) ..... 10 2013 017 232

(51) Int. Cl.
*H01H 37/54* (2006.01)

(52) U.S. Cl.
CPC ..... *H01H 37/54* (2013.01); *H01H 37/5427* (2013.01); *H01H 2037/5445* (2013.01); *H01H 2037/5454* (2013.01); *H01H 2037/5463* (2013.01)

(58) Field of Classification Search
CPC ..... H01H 37/54; H01H 37/5427; H01H 2037/5445; H01H 2037/5454; H01H 2037/5463
USPC ..... 337/343, 365
See application file for complete search history.

(56) References Cited

U.S. PATENT DOCUMENTS 4,306,211 A * 12/1981 Hofsass ..... H01H 37/54 337/365
4,470,033 A * 9/1984 Hofsass ..... H01H 37/5427 337/343
4,847,587 A 7/1989 Müller
4,952,901 A * 8/1990 Chrupcala ..... H01H 37/54 337/354
5,043,690 A * 8/1991 Wahls ..... H01H 37/54 337/342
5,670,930 A 9/1997 Hofäss et al.
5,717,257 A 2/1998 Hofäss
5,745,022 A 4/1998 Becher et al.
5,757,261 A * 5/1998 Becher ..... H01H 11/0006 337/104
5,892,429 A * 4/1999 Hofsass ..... H01H 1/504 337/102

(Continued)

FOREIGN PATENT DOCUMENTS

CN 102693869 A 9/2012
DE G 86 90 1503.8 1/1988

(Continued)

OTHER PUBLICATIONS

EPO machine translation of Hofsaess EP 2503576.*
European Search Report; dated Apr. 22, 2015; 4 pp.
Chinese Examination Report (English translation attached); dated Jun. 2, 2017; 9 pp.

*Primary Examiner* — Jacob R Crum
(74) *Attorney, Agent, or Firm* — Harness, Dickey & Pierce, P.L.C.

(57) ABSTRACT

A temperature-dependent switching mechanism is equipped with a bimetal snap-action disc and a spring snap-action disc, which carries a movable contact part, the bimetal snap-action disc and the spring snap-action disc being captively held in an annular frame.

21 Claims, 9 Drawing Sheets

(56) References Cited

U.S. PATENT DOCUMENTS

| | | | | | |
|---|---|---|---|---|---|
| 5,973,587 | A * | 10/1999 | Hofsass | H01H 1/504 | 337/333 |
| 6,100,784 | A * | 8/2000 | Hofsass | H01H 11/0056 | 337/333 |
| 6,249,211 | B1 * | 6/2001 | Hofsaess | H01H 1/504 | 337/333 |
| 8,847,725 | B2 * | 9/2014 | Buettner | H01H 37/5427 | 337/298 |
| 2004/0045363 | A1 * | 3/2004 | Davis | G01L 5/0057 | 73/763 |
| 2012/0126930 | A1 | 5/2012 | Hofsaess | | |
| 2012/0286923 | A1 * | 11/2012 | Buettner | H01H 37/5427 | 337/365 |
| 2013/0127586 | A1 | 5/2013 | Hofsaess | | |
| 2015/0077213 | A1 | 3/2015 | Le Nguyen | | |

FOREIGN PATENT DOCUMENTS

| | | | |
|---|---|---|---|
| DE | 195 06 342 | C1 | 5/1996 |
| DE | 195 27 254 | A1 | 1/1997 |
| DE | 43 45 350 | C2 | 5/1997 |
| DE | 20 2005 019 880 | U1 | 3/2006 |
| DE | 10 2011 119 633 | B3 | 4/2013 |
| DE | 20 2013 101 153 | U1 | 5/2013 |
| DE | 10 2013 101 393 | A1 | 8/2014 |
| EP | 0 756 301 | A2 | 1/1997 |
| EP | 2 503 576 | A1 | 9/2012 |
| EP | 2 503 581 | A1 | 9/2012 |
| WO | WO 2010/139781 | A1 | 12/2010 |
| WO | 2014/124929 | A1 | 8/2014 |

* cited by examiner

TEMPERATURE-DEPENDENT SWITCHING MECHANISM

RELATED APPLICATION

This application claims priority to German patent application DE 10 2013 017 232.2, filed Oct. 17, 2013, which is incorporated herein by reference.

FIELD OF THE INVENTION

The present invention relates to a temperature-dependent switching mechanism comprising a bimetal snap-action disc and a movable contact member and preferably further a spring snap-action disc.

BACKGROUND OF THE INVENTION

A temperature-dependent switching mechanism of this type and also a temperature-dependent switch equipped therewith are known for example from DE 43 45 350 A1.

The known temperature-dependent switch comprises a housing with a metal lower part and a metal cover part. A temperature-dependent switching mechanism is accommodated in the housing, and said switching mechanism, depending on the temperature thereof, produces an electrically conductive connection between the lower part and the cover part of the housing.

The switching mechanism is provided with a spring snap-action disc and a bimetal snap-action disc. Here, the spring snap-action disc carries what is known as a movable contact part and serves as contact member, which movable contact part is pressed by the spring disc against a stationary counter contact internally on the cover part, which forms a first contact surface. The spring snap-action disc is supported by means of the rim thereof on a second contact surface in the lower part of the housing, such that the electric current flows from the lower part, through the spring snap-action disc and the movable contact part, into the stationary counter contact and from there into the cover part.

The lower part of the housing is pot-like, and on the inner side thereof has a peripheral shoulder on which the spring snap-action disc of the temperature-dependent switching mechanism rests.

The spring snap-action disc carries centrally a welded contact part, over which the bimetal snap-action disc is put, such that the bimetal snap-action disc rests loosely on the spring snap-action disc.

The cover part of the housing rests on a further peripheral shoulder of the lower part. Because the lower part and cover part of the housing are fabricated from electrically conductive material, an insulating foil is arranged therebetween, which foil electrically insulates the lower part and cover part of the housing with respect to one another.

The outer surface of the cover part of the housing serves as a first outer connection, and a first stranded wire is soldered on there. The outer surface of the lower part serves as a second outer connection, and a connection point is fixed there, to which a second connection stranded wire is soldered.

The known temperature-dependent switch is used to protect electrical devices against overheating. For this purpose, said switch is mounted on the device to be protected, such that the switch is in thermal contact with the device.

The supply circuit of the device is guided via the temperature-dependent switch by connecting a connection cable of the device to one of the outer connections of the switch and by connecting the other outer connection of the switch to the voltage supply for the device.

Due to the thermal coupling, the temperature-dependent switch always has the temperature of the electrical device to be protected. If the temperature of the device now rises above a predefined response temperature, the bimetal snap-action disc thus transfers into the high-temperature position thereof, in which it opens the switch, such that the supply circuit of the device is interrupted, and consequently the device cannot heat up further.

With this construction, the bimetal snap-action disc is arranged in a mechanically force-free manner when below the transition temperature thereof, wherein the bimetal snap-action disc also is not used to conduct the operating current of the device to be protected.

Here, it is advantageous that the bimetal snap-action discs have a long mechanical service life, and that the switching point, that is to say the transition temperature of the bimetal snap-action disc, does not change even after many switching operations.

In addition, it is known to provide switches of this type with a parallel resistor, which is connected in parallel with the external connections. This parallel resistor, when the switch is open, takes on some of the operating current and holds the switch at a temperature above the transition temperature, such that the switch does not automatically close again after cooling. Switches of this type are called self-holding switches.

It is further known for switches of this type to be equipped with a series resistor, through which flows the operating current flowing through the switch. A resistive heat, which is proportional to the square of the flowing operating current, is thus produced in the series resistor. If the amperage exceeds an admissible measure, the heat of the series resistor thus causes the switching mechanism to be opened.

A device to be protected is thus then already switched off from the supply circuit thereof in the case of an excessively high current flow that has not yet even caused the device to be excessively heated.

In contrast to the embodiment of the switch according to DE 43 45 350 A1, the temperature-dependent switching mechanism may also comprise merely a bimetal snap-action disc, which carries the movable contact part and thus conducts the operating current.

When the temperature-dependent switch is to conduct particularly high currents, a current transfer member in the form of a contact bridge or a contact plate is often used as a contact member and is moved by a spring part, that is to say a spring snap-action disc and/or a bimetal snap-action disc, and carries two contact parts, which cooperate with two stationary counter contacts, which are electrically connected to the outer connections of the switch.

The operating current of the device to be protected thus flows from the first counter contact, via the first contact part, into the contact plate, through said contact plate to the second contact part, and from here into the second counter contact. The spring part is thus free of current flow.

It is also known to form a contact bridge on the spring part itself, that is to say for example the bimetal snap-action disc or a spring snap-action disc working against a bimetal part, and said contact bridge therefore is not a separate component. The operating current then flows through the spring snap-action disc thus equipped.

All of these different construction variants can be implemented with the switch according to the invention.

The switching function of the switching mechanism known from DE 43 45 350 A1 can only be tested reliably once the switch has been fully assembled.

This is associated with the immediately evident disadvantage that the entire switch has to be rejected both in the event of problems with the contact making of the movable contact part and/or of the spring snap-action disc and also in the event of a malfunction or incorrect installation of the bimetal snap-action disc.

Although the known temperature-dependent switching mechanism and also the known temperature-dependent switched equipped therewith meet all requirements in terms of function, there is therefore a need to improve the testing capability and assembly.

A further disadvantage with the known switch lies in the fact that at least the lower part of the housing has to be fabricated very precisely so that the spring snap-action disc can be supported reliably via the rim thereof on the peripheral shoulder. On this basis, the lower parts of the known temperature-dependent switch are rotary parts, generally made of brass, which does signify highly precise manufacture, but is associated with high production and unit costs.

Although temperature-dependent switches of this type have proven very effective in everyday use, the assembly of the switch is still time-consuming and cost-intensive, wherein a testing of the known switch is only possible following complete assembly.

DE 195 27 254 A1 discloses a temperature-dependent switch having a housing wherein a temperature-dependent switching mechanism comprised of a bimetal and a spring snap-action disc is arranged. The bimetal and spring snap-action discs are captively held at a movable contact part. The bimetal snap-action disc is arranged with its rim between a shoulder of an annular isolating ring and a housing cover part. Beneath the bimetal snap-action disc the spring snap-action disc is provided and arranged with its rim loosely between a contact ring on an inner bottom of the housing lower part and an electrically conductive distance ring. The relative arrangement of the spring and bimetal snap-action discs with respect to each other can be reversed.

DE 86 90 150 U1 discloses a temperature-dependent switch wherein a rectangular bimetal snap-action disc is arranged below a carrier plate and loosely held in place via protrusions extending over the edges of the bimetal snap-action disc.

DE 20 2005 019 880 U1 discloses a temperature-dependent switch wherein a circular bimetal snap-action disc is arranged below a heat transfer plate and loosely held in place via four hooks extending over the rim of the bimetal snap-action disc.

DE 10 2011 119 633 B1 discloses a temperature-dependent switch having a housing wherein a temperature-dependent switching mechanism comprised of a bimetal and a spring snap-action disc is arranged. The bimetal and spring snap-action discs are captively held at a contact plate cooperating with two stationary contacts provided at an inner side of the housing cover part. The spring snap-action disc is arranged above the bimetal snap-action disc and is guided with its rim between an inner shoulder of the housing lower part and a ring arranged between said shoulder and the cover part.

SUMMARY OF THE INVENTION

In view of the above, it is among others an object of the present invention to improve the known switching mechanism in such a way that the assembly of the temperature-dependent switch equipped therewith is simplified, whereby the switch itself can also be constructed in a mechanically simpler and more cost-effective manner.

With the temperature-dependent switching mechanism mentioned at the outset, this object is achieved in accordance with the invention in that the switching mechanism has an annular frame, in which the bimetal snap-action disc and the optionally provided spring snap-action disc are captively held.

The inventors of the present application have recognized that a temperature-dependent switching mechanism can be constructed like a push button so to speak, that is to say with an annular frame, in which the bimetal snap-action disc or both snap-action discs are captively held, which is preferably implemented via the rims of said snap-action discs, in order to enable the snapping over of the snap-action discs at the respective centres thereof.

This construction, which at first glance is more complex in terms of design, is associated with a large number of advantages, which ultimately result in the fact that temperature-dependent switches equipped with the new switching mechanism can be constructed and assembled more easily.

The snap-action disc or each snap-action disc is captively arranged in the annular frame such that the switching mechanism can be pre-produced and tested, without the need for the complete assembly of a temperature-dependent switch itself.

The snap-action disc or each snap-action disc is protected here mechanically against damage by the annular frame, such that the completed and tested new switching mechanisms can be stored temporarily in bulk, which is the precondition for subsequent automatic assembly of the switches equipped with the new switching mechanism.

Because the snap-action disc or each snap-action disc is now arranged in the annular frame, the lower parts of a temperature-dependent switch equipped therewith can be structured more simply, rotary parts for example made of brass are no longer necessary.

The lower part of a temperature-dependent switch, which is formed with the new switching mechanism, is preferably therefore a cost-effective deep-drawn part made of steel.

The mechanical protection of the snap-action disc or each snap-action disc by the annular frame also provides more freedom with respect to the shaping of the housing of the temperature-dependent switches equipped with the new switching mechanism, since the snap-action discs no longer have to orient itself and to be supported in the housing, but instead by means of the annular frame.

The new switching mechanism can be placed both in a two-part housing and in a one-part housing, or what is known as a slip-in housing.

Whereas, in accordance with the invention, it is also foreseen that the new switching mechanism has merely a bimetal snap-action disc, which produces the closing pressure and also conducts the operating current, it is particularly preferred if the new switching mechanism has a bimetal snap-action disc and a spring snap-action disc, wherein both snap-action discs are arranged one above the other.

Here, the annular frame does not necessarily have to be circular, but may also be oval, rectangular, square or rounded in an elongate manner. The snap-action disc or each snap-action disc then also has a corresponding shape. This is then advantageous in particular when the new switching mechanism is to be inserted into a slip-in housing.

If, by contrast, the new switching mechanism is used in a conventional temperature-dependent switch having a two-part housing formed from a lower part and cover part, the annular frame and the one snap-action disc or both snap-action discs are preferably circular.

The movable contact member here may be either a contact bridge, on which two contact parts are arranged, which are electrically interconnected via the contact bridge and each cooperate with a stationary counter contact, or a contact part, which cooperates with a stationary counter contact, wherein the operating current then flows via a snap-action disc.

Here, the contact member may either be a separate part, or can be formed on the bimetal snap-action disc and/or the spring snap-action disc itself.

In the case of a temperature-dependent switch equipped with the new switching mechanism, the annular frame may additionally compensate for height and curvature tolerances of the snap-action discs, such that no further measures have to be taken in this respect.

Here, the frame can be formed such that the overall height thereof can be readjusted by suitable deformation of the rim of the frame so as to compensate for installation tolerances.

A subsequent adjustability of this type has not been known previously in the prior art and also has not been possible technically.

According to one object, the annular frame has an upper ring surface and preferably has a lower ring surface, wherein the upper and the lower ring surface are further preferably arranged parallel to one another and are interconnected by means of a peripheral cylinder surface running transversely to the ring surfaces.

These measures are advantageous in terms of design and enable the annular frame to be fixed not only in the assembled temperature-dependent switch, but also already outside a switch for testing purposes, without the risk that the snap-action discs housed in the frame will be damaged.

The annular frame can be contacted via the upper and/or lower ring surface and also optionally the cylinder surface, that is to say for example the electrical contact to a lower part consisting of conductive material or a test device can be made.

Further, a conical transition surface may be arranged between the cylinder surface and the lower ring surface.

This conical transition surface enables the placement of the new switching mechanism in deep-drawn lower parts, in which the transition between the base and the peripheral wall is not exactly right-angled. Here, it is thus advantageous that cost-effective lower parts of simple design can be used for the switches equipped with the new switching mechanism.

The movable contact member may be formed as a movable contact part, which is arranged between bimetal snap-action disc and spring snap-action disc.

During assembly, a snap-action disc is then firstly placed in the annular frame, then the movable contact part is placed on the snap-action disc, and then the other snap-action disc is inserted into the frame. Because the lower snap-action disc is already held in the frame when the movable contact part is placed in position, the assembly of the new switching mechanism is very simple.

The lower snap-action disc can be held specifically more easily and more reliably via the annular frame than a loose snap-action disc, wherein the risk that the snap-action disc will be damaged already during this assembly step is also eliminated.

According to another object, the bimetal snap-action disc is fixed captively with play on the movable contact member and the spring snap-action disc is preferably fixed captively on the movable contact member.

With this measure, it is advantageous that the three active components of the new switching mechanism, that is to say the bimetal snap-action disc, the spring snap-action disc and the movable contact member, do not have to be placed in succession in the annular frame, which technically is by all means possible, but can be introduced into the frame in the form of a unit. This facilitates the assembly of the new switching mechanism.

A lower peripheral shoulder may be arranged in the frame, on which shoulder the bimetal snap-action disc is supported via the rim thereof as it transitions into the low-temperature position thereof, wherein an upper peripheral shoulder may be arranged inwardly in the frame, on which shoulder the spring snap-action disc is fixed via the rim thereof.

Here, it is advantageous that the two shoulders used for the switching function are arranged inwardly in the annular frame, such that neither the rim of the bimetal snap-action disc nor the rim of the spring snap-action disc protrudes upwardly or downwardly beyond the frame when the switching mechanism is for example tested outside a switch and is exposed here both to high and to low temperatures.

In the low-temperature position, the spring snap-action disc is supported via the rim thereof on the upper peripheral shoulder and presses the movable contact member upwardly, in the assembled switch that is to say against the, or each, stationary contact part. The bimetal snap-action disc is force-free beneath the spring snap-action disc in this closed position.

When switching into the high-temperature position, the bimetal snap-action disc presses via the rim thereof against the spring snap-action disc from below and thus opens the switch.

When switching back into the low-temperature position, the bimetal snap-action disc first snap-actions back, wherein it is now supported via the rim thereof on the lower shoulder due to the movable contact member being positioned further down to the lower ring surface, and the centre of said bimetal snap-action disc presses the centre of the spring snap-action disc and also the movable contact upwardly, whereby the spring snap-action disc is pressed back into the first geometrically stable position thereof, in which it holds the switch electrically closed.

Following this switchover, the bimetal snap-action disc again is arranged force-free in the frame.

Within the scope of the present invention, "up" or "above" is understood to mean a direction from the bimetal snap-action disc to the stationary contact member, wherein "down" or "below" is understood to mean a direction from the spring snap-action disc to the bimetal snap-action disc arranged therebelow.

In contrast to the switching mechanism from DE 43 45 350 C2 mentioned in the outset, the bimetal snap-action disc is arranged below the spring snap-action disc in accordance with the invention.

According to a further object, the upper shoulder is arranged in a groove running peripherally inwardly in the frame, in which groove the spring snap-action disc is fixed via the rim thereof, wherein the rim of the spring snap-action disc may be latched in the groove or alternatively is fixed by a protrusion shaped following the placement of the rim of the spring snap-action disc on the upper shoulder.

This measure is on the one hand advantageous for function, since the rim of the spring snap-action disc is fixed upwardly and downwardly, but can expand radially outwardly in the groove, such that the spring snap-action disc is not loaded mechanically when transitioning from one to the other geometrically stable positions thereof.

However, these measures are also advantageous in terms of the assembly of the switching mechanism, because specifically the spring snap-action disc in one case is latched in the groove merely by being pressed downwardly.

In the other case, the three active components are first placed individually, or as a unit connected to one another for example via the movable contact member, in the annular frame and then a protrusion is shaped via the rim of the spring snap-action disc.

Due to the shaping of the protrusion, the overall height of the annular frame can be adjusted here at the same time.

According to a further object, the switching mechanism has a flat sheet-like current transfer member, which is connected to the contact member formed as a movable contact part, wherein the current transfer member is preferably connected to the annular frame.

The connection to the annular frame can be established here on the one hand in that the current transfer member rests via the rim thereof on the lower shoulder, that is to say is arranged on the side of the bimetal snap-action disc.

The current transfer member may also be arranged on the side of the spring snap-action disc and may be arranged via its rim in the peripheral groove.

With these measures, it is advantageous that arcs formed during the opening and/or closing of a temperature-dependent switch equipped with the new switching mechanism do not lead to damage, as would be the case without this current transfer member. For this reason, the current transfer member is an arc shield in terms of function, as is described in detail in not pre-published DE 10 2013 101 393.

The foot of the arc specifically migrates from the movable contact part to the spring part specifically at the end of the service life of a temperature-dependent switching mechanism, which, due to the extremely low thickness of said spring part, then causes holes to be burned in the spring part or causes greater quantities of metal oxide to be deposited there.

A covering of the upper side of the spring part just in regions unexpectedly provides protection both against splattering sparks and metal oxides and against direct contact with the arc foot.

Surprisingly, this extremely simple measure extends the service life of the new switches with otherwise identical construction and identical amperage, wherein it has even been found that the maximum amperage to be conducted and the service life of a switch equipped with the new switching mechanism can be increased at the same time.

When the current transfer member is connected both to the movable contact part and to the annular frame, this constitutes a permanent electrical connection between the movable contact part and the annular frame, that is to say that the current transfer member is electrically connected in parallel with the spring snap-action disc in the case of an electrically conductive annular frame and enables a higher intensity of the flowing operating current.

Alternatively, it is also possible for the current transfer member to be arranged with the rim thereof above the upper ring surface or below the lower ring surface.

This means that the current transfer member is not arranged completely within the annular frame. The rim of the current transfer member can be fixed here on the upper or lower ring surface, for example by spot welding.

During assembly of a temperature-dependent switch equipped with the new switching mechanism, the current transfer member is thus clamped via the rim thereof between the lower ring surface and the base of the housing lower part or between the upper ring surface and the inner side of the cover.

When the rim of the current transfer member is not attached to the upper or lower ring surface, the electrical contact of the rim of the current transfer member only takes place finally during assembly of the switch equipped with the new switching mechanism.

According to still a further object, the annular frame comprises electrically conductive material or electrically insulating material.

When the annular frame itself is electrically conductive, the operating current of the device to be protected flows through the frame itself and through the spring snap-action disc or the bimetal snap-action disc, if, in the case of a simple switch, the spring snap-action disc is omitted, and flows from this disc through the movable contact part.

If, by contrast, the frame is made of electrically insulating material, the current is conducted through the current transfer member, which is contacted as described above, or through the contact member formed as a contact bridge with two contact parts.

The current transfer member may then constitute a small series resistor, such that it ensures, as a heating resistor, a current-dependent switching function. This is then particularly expedient when the current transfer member rests via the rim thereof below the lower ring surface, because it is then located in the direct vicinity of the bimetal snap-action disc, which is then effectively heated by the developed resistive heat.

It is then further advantageous that the spring snap-action disc, which when the switch is closed ensures the contact pressure between the movable contact part and the stationary counter contact, is not heated too much, thus increasing the service life thereof.

When the frame consists of electrically insulating material, the operating current flows through the movable contact part and the current transfer member, and the spring snap-action disc is always free of current flow, thus likewise increasing the service life of the spring snap-action disc.

In one embodiment, the annular frame comprises electrical resistance material, preferably at least one resistive layer.

The frame may consist here itself for example of PTC material or another suitable material, wherein it may serve, depending on wiring and arrangement, as a self-holding resistor and/or as a series resistor for current-dependent switching.

Even if the contact member is formed as a contact plate having two contact parts, a frame made of resistance material can serve as a self-holding resistor.

It is also possible to provide the annular frame with a resistive layer that is arranged on the upper ring surface, the lower ring surface and/or the cylindrical outer wall and that serves as a self-holding resistor or series resistor for current-depending switching.

Alternatively or additionally, the current transfer member may also be formed with a corresponding resistance value, such that it provides current-dependent switching.

Depending on the material of the annular frame, the switching mechanism can also be used to stabilize the housing, wherein the switching mechanism can also be inserted directly into a receiving opening in a device, as is known in principle from DE 195 06 342 01.

Because all functionally relevant tests can be performed already on the switching mechanism, which is not yet installed in a temperature-dependent switch, the reject costs are further considerably reduced.

In view of the above, the present invention also relates to a temperature-dependent switch comprising a pot-like lower part, which is closed by a cover part, and comprising two outer connections, wherein the new temperature-dependent switching mechanism is arranged in the switch and produces an electrically conductive connection between the two outer connections depending on the temperature of the switching mechanism.

The present invention also relates to a temperature-dependent switch comprising a slip-in housing, on which two outer connections are provided, wherein the new temperature-dependent switching mechanism is inserted into the slip-in housing and produces an electrically conductive connection between the two outer connections depending on the temperature of the switching mechanism.

Further advantages are apparent from the description and the accompanying drawing.

It goes without saying that the features mentioned above and the features yet to be explained below can be used not only in each of the specified combinations, but also in other combinations or alone, without departing from the scope of the present invention.

BRIEF DESCRIPTION OF THE DRAWINGS

Embodiments of the invention are illustrated in the accompanying drawing and will be explained in greater detail in the following description. In the drawing.

DESCRIPTION OF PREFERRED EMBODIMENTS

Figure 1:
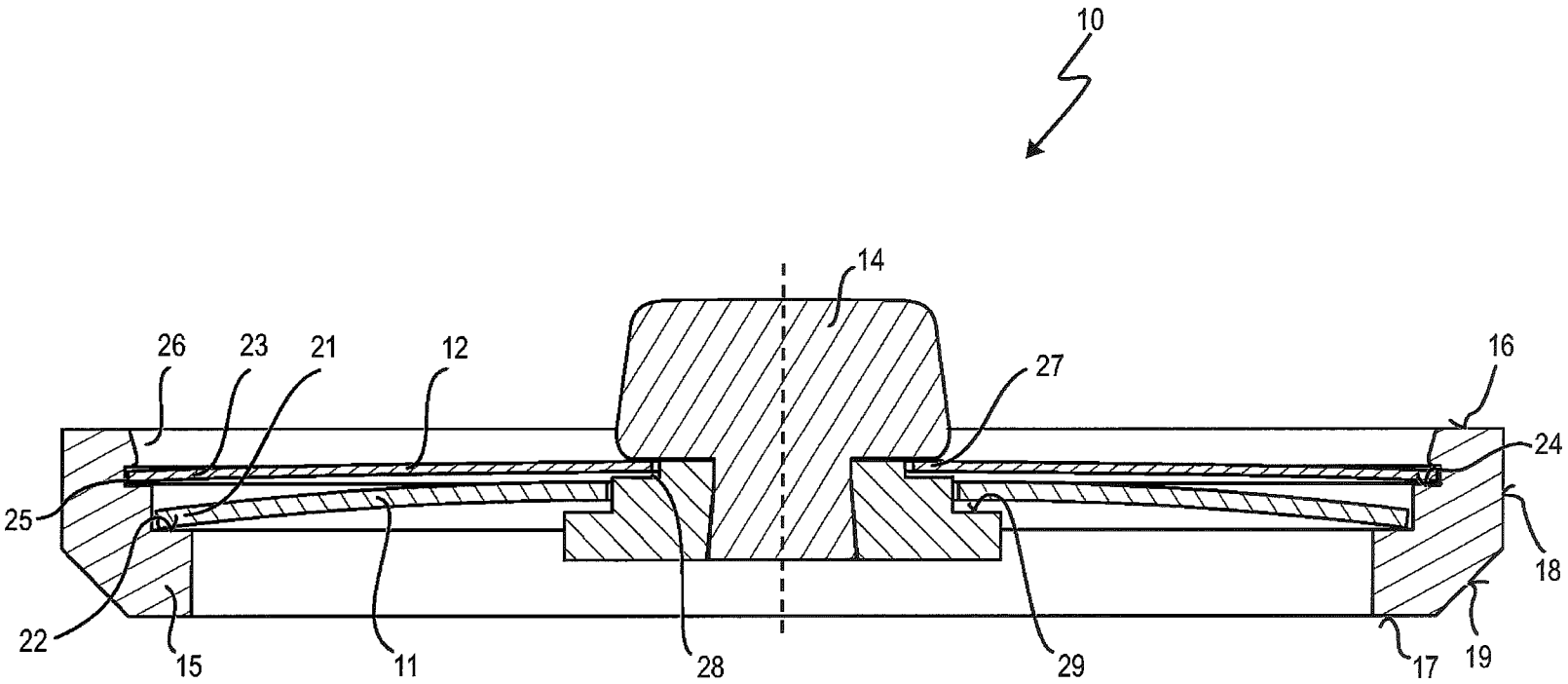
FIG. 1 shows a first embodiment of a switching mechanism with annular frame in a schematic, sectional illustration.

In FIG. 1, a temperature-dependent switching mechanism is denoted by 10 and comprises a circular bimetal snap-action disc 11 and also a circular spring snap-action disc 12 arranged above the bimetal snap-action disc 11. The bimetal snap-action disc 11 and the spring snap-action disc 12 are arranged captively on a movable contact part 14.

The bimetal snap-action disc 11 and the spring snap-action disc 12 are held captively in an annular frame 15, which is likewise circular and which comprises an upper ring surface 16 and also a lower ring surface 17 parallel thereto and arranged radially further inwardly than the upper ring surface 16. The upper ring surface 16 and the lower ring surface 17 are interconnected via a cylinder surface 18 running transversely to the ring surfaces 16, 17 and also via a conical transition surface 19, which runs at an incline between the cylinder surface 18 and the lower ring surface 17.

Whereas the movable contact part 14 protrudes upwardly beyond the upper ring surface 16, the lower ring surface 17 protrudes downwardly beyond the movable contact part 14 and in particular beyond the bimetal snap-action disc 11 and also the spring snap-action disc 12, such that, when the switching mechanism 10 is opened, the movable contact part 14 does not protrude downwardly beyond the lower ring surface 17, such that no special measures have to be taken in order to prevent contact between the movable contact part 14 and an inner base of a switch equipped with the switching mechanism, when the switch is opened.

The bimetal snap-action disc 11 rests loosely via the rim 21 thereof on an annular lower shoulder 22 running peripherally internally in the frame 15.

The spring snap-action disc 12 rests via the rim 23 thereof on an upper shoulder 24 running peripherally in an annular manner internally in the frame 15 and formed in a groove 25, which is formed by the shoulder 24 and also a protrusion 26 extending over the rim 23.

In this way, the spring snap-action disc 12 is held captively via the rim 23 thereof in the groove 25 and therefore in the frame 15.

At its inner portion 27, the spring snap-action disc sits captively, but with play in a peripheral groove 28, which is arranged on the movable contact part 14.

The bimetal snap-action disc 11 is held captively, but with play between the spring snap-action disc 12 and a peripheral shoulder 29 on the movable contact part.

The switching mechanism 10 can be tested even before installation in a switch and can be stored in bulk form because the rims 21, 23 of the snap-action discs 11, 12 are protected by the frame 15 and the spring snap-action disc 12 can be contacted via the frame 15.

As mentioned above, the switching mechanism 10 can alternatively comprise only one snap-action disc, in this case bimetallic snap-action disc 11, that is to be arranged within frame 15 the same way as shown in FIG. 1 for spring snap-action disc 12. Bimetallic snap-action disc 11 is in such case arranged with its rim within groove 25 and, thereby, held captively in frame 15. Further, bimetallic snap-action disc 11 in this case carries movable contact part 14 and is arranged with play via its inner portion in peripheral groove 28.

Figure 2:
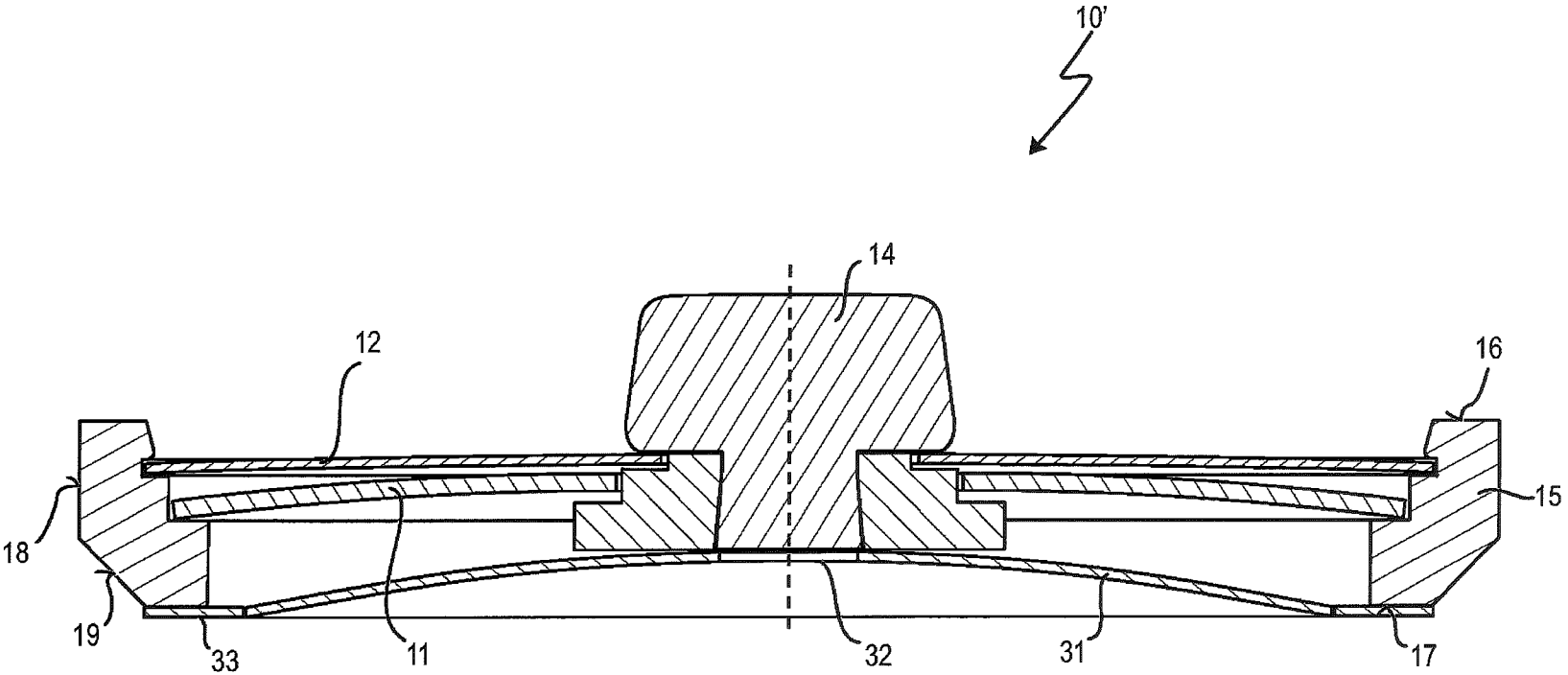
FIG. 2 shows a further embodiment of the new switching mechanism in an illustration similar to FIG. 1.

The temperature-dependent switching mechanism 10' shown in FIG. 2 is in principle constructed similarly to the switching mechanism from FIG. 1, however it is additionally provided with a sheet-like current transfer member 31, which is welded at the centre 32 thereof to the movable contact part 14.

The current transfer member 31 protrudes via the rim 33 thereof beyond the lower ring surface 17. The rim 33 can be fixedly connected to the ring surface 17 by spot welding. The switching mechanism 10' can thus also be tested prior to installation.

Figure 3:
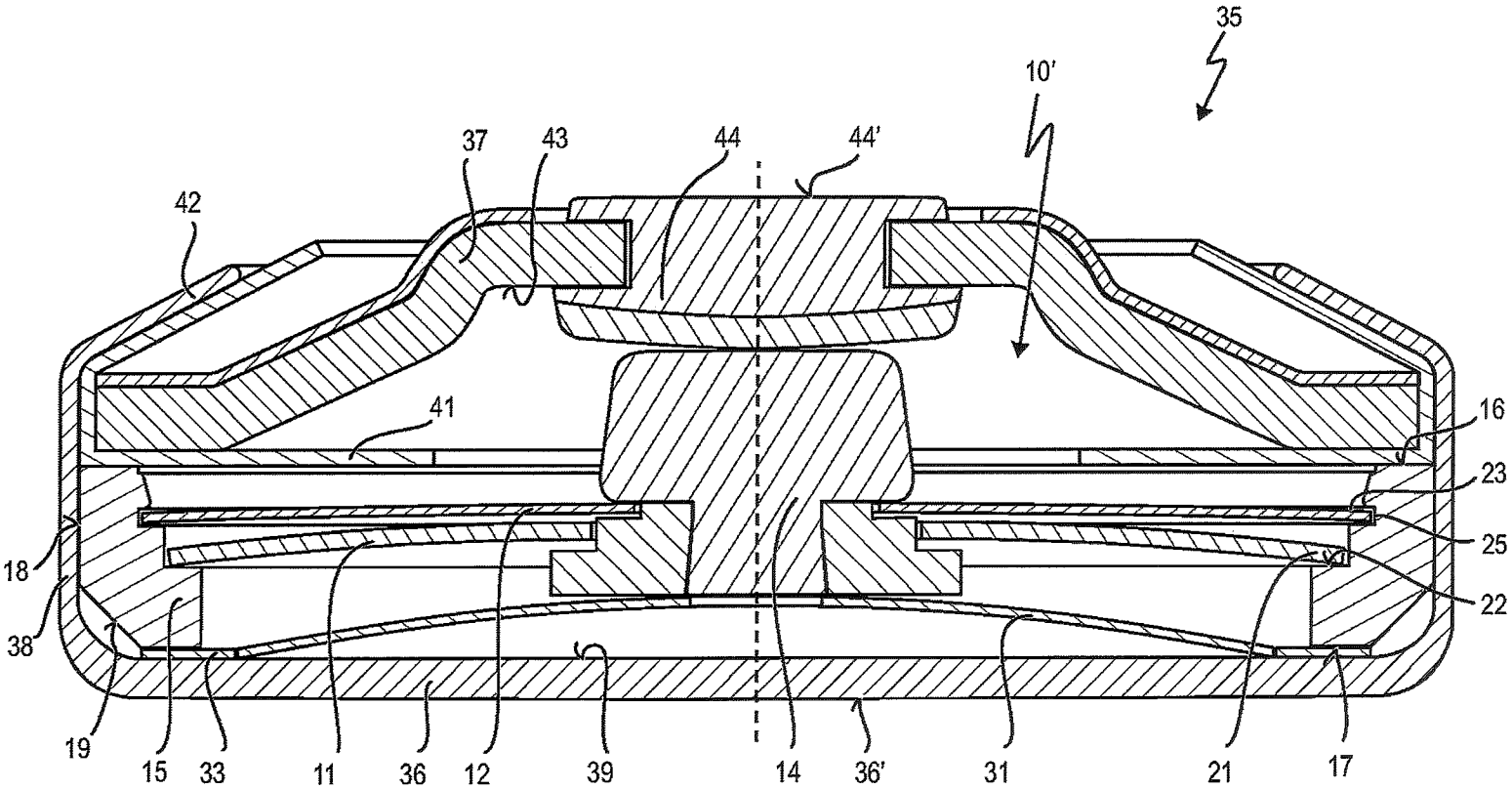
FIG. 3 shows a schematic sectional side view of a temperature-dependent switch equipped with the switching mechanism from FIG. 2.

A temperature-dependent switch 35 is shown in FIG. 3, said switch having a pot-like lower part 36, which is closed by a plate-like cover part 37.

The switching mechanism 10' from FIG. 2 is placed in the lower part 36 such that the frame 15 bears internally via the cylinder surface 18 thereof against a peripheral wall 38 of the lower part 36, and the peripheral wall 38 is thus stabilized.

Due to the placement of the switching mechanism 10' in the lower part 36, the current transfer member 31 is clamped via the rim 33 thereof between the lower ring surface 17 and an inner base 39 of the lower part 36.

The lower part 36 is a deep-drawn part, such that the transition between wall 38 and base 39 is not formed exactly, in particular not at right angles. Because the frame 15 has the conical transition surface 19, it can nevertheless be positioned exactly in the lower part 36.

An insulating foil 41 lies on the upper ring surface 16 of the frame 15 and extends upwardly laterally between the cover part 37 and the wall 38 and is then pressed from above onto the cover part 37, for which purpose the wall 38 has been flanged at the upper edge 42 thereof.

In this way, the edge 42 presses onto the cover part 37, and said cover part presses via the insulating foil 41 onto the upper ring surface 16, whereby the frame 15 and therefore the switching mechanism 10' is fixedly assembled in the temperature-dependent switch 35 and at the same time the electrical contact between the inner base 39 of the lower part 36 and also the rim 33 of the current transfer member 31 is produced.

The annular frame 15 can be manufactured here both from electrically conductive material and from electrically insulating material.

A stationary counter contact 44 is arranged on an inner surface 43 of the cover part 37 and bears against the movable contact part 14 in the closed state of the switch 35 shown in FIG. 3.

In the switching state shown in FIG. 3, the bimetal snap-action disc 11 is placed in a force-free manner in the switching mechanism 10', whereas the spring snap-action disc 12 is supported via the rim 23 thereof in the grove 25 and presses the movable contact part 14 against the stationary counter contact 44. In this way, the electrical circuit between the stationary counter contact 44 and the lower part 36 consisting here of electrically conductive material is closed, wherein the operating current of a device to be protected flows via the current transfer member 31 and, where applicable, also via the spring snap-action disc 12.

The switch 35 has two outer connections, which are formed by the outer base 36' of the lower part 36 and the outer surface 44' of the stationary counter contact 44. When the switch 35 is closed, the two outer connections 36' and 44' are electrically conductively interconnected.

When the temperature of the switch 35 rises above the transition temperature of the bimetal snap-action disc 11, said disc moves upwardly with its rim 21 in FIG. 3 and presses from beneath against the spring snap-action disc 12. Here, it draws the movable contact part 14 downwardly away from the stationary counter contact 44 until the spring snap-action disc 12 snaps over from one stable geometric configuration thereof as shown in FIG. 3 into the other stable geometric configuration thereof, in which it holds the movable contact part 14 at a distance from the stationary counter contact 44.

When the temperature of the switch 35 decreases again, the bimetal snap-action disc first snaps back into the configuration thereof shown in FIG. 3. Because the movable contact part 14 is now positioned further below in the direction of the base 39, the bimetal snap-action disc 11 comes into contact here via the rim 21 thereof with the peripheral shoulder 22 and, with further shape change, presses the movable contact 14 toward the stationary counter contact 44 via the centre of the spring snap-action disc 12. Here, the spring snap-action disc 12 is also being curved upwardly in the middle thereof, until it snaps back into the stable geometric configuration thereof shown in FIG. 3, in which it presses the movable contact 14 against the stationary counter contact 44.

The bimetal snap-action disc 11 is again supported in a force-free manner in this switching state.

When the annular frame 15 consists of an electrically insulating material, it is possible to dispense with the insert of the insulating foil 41. The operating current then flows only through the current transfer member 31 when the switch 35 is closed, said current transfer member heating up during this process depending on the volume resistivity thereof.

Because the current transfer member 31 is arranged on the side of the bimetal snap-action disc 11, the resistive heat developing leads to a rapid heating of the bimetal snap-action disc 11, which ensures an accurate response of the switch 35 to an excessively high operating current of a device to be protected.

Because the spring snap-action disc 12 remains free of current flow in this embodiment, it has a long service life.

If the annular frame 15 consists of an electrically conductive material or is covered by a layer of an electrically conductive material, it constitutes a parallel resistor, which is connected both to the electrically conductive cover part 37 and to the electrically conductive lower part 36, parallel to the switching mechanism 10'. The insulating foil 41 is then dispensed with.

Provided the switching mechanism is closed, the self-holding resistor thus formed is short-circuited by the current transfer member 31, which is a good electrical conductor. However, when the switch 35 opens, the self-holding resistor formed by the annular frame 15 is now in series between the stationary counter contact 44 and the lower part 36, such that a residual current flows through the switch 35 and holds the switching mechanism open until the voltage supply of the electrical device to be protected is switched off.

Serving as heating resistor, the current transfer member 31 can additionally provide current-dependent switching.

In a modification, the switching mechanism 10 from FIG. 1 can be used with the switch from FIG. 3, such that the current flow is then realized exclusively through the spring snap-action disc 12.

In this case too, the annular frame 15 may consist of electrically conductive material or may have an electrically conductive layer, for example on the cylinder surface 18 or the lower ring surface 17.

In this way, a series resistor would then be formed, which is connected in series with the spring snap-action disc 12 and provides current-dependent switching of the switch 35 in the manner discussed before.

Furthermore, the frame 15 can be covered with resistance material such that it acts as a self-holding resistor.

The height of the frame 15 between the upper and lower ring surface 16, 17 can be selected here such that the movable contact part 14 does not come into contact with the base 39 when the switch 35 is open.

Figure 4:
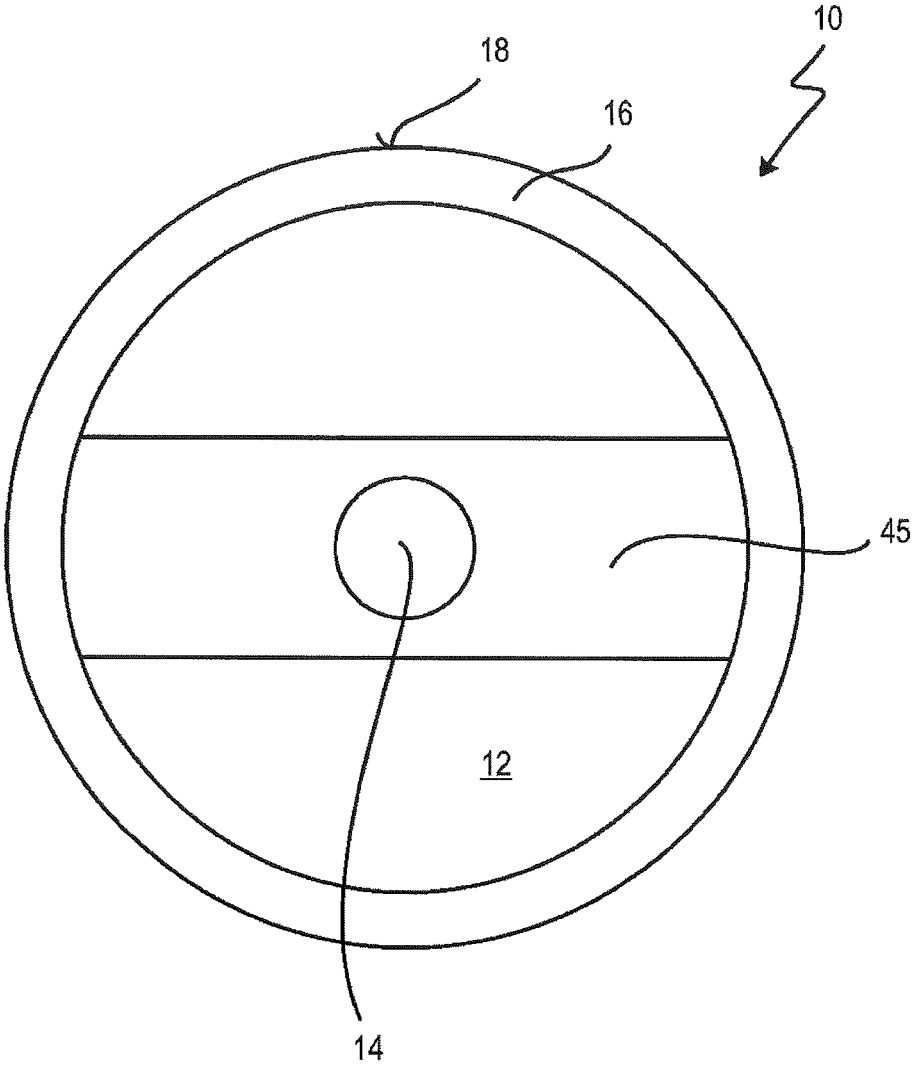
FIG. 4 shows a plan view of the switching mechanism from FIG. 1, but with additional current transfer member.

Whereas FIG. 2 shows a current transfer member 31 which protrudes downwardly beyond the lower ring surface 17, FIG. 4 shows a plan view of the switching mechanism 10 from FIG. 1, which is now provided with a current transfer member 45, which on the one hand is connected to the movable contact part 14 and on the other hand is connected to the upper ring surface 16, below which is extends.

Alternatively, the current transfer member 45 could also extend over the upper ring surface 16, such that it would then be clamped in a switch 35 between the upper ring surface and inner surface 43 of the cover part 37.

In the switching mechanism 10 from FIG. 4, the current transfer member 45 is permanently connected however both to the movable contact part 14 and to the frame 15, such that it not only serves for conducting the current, but also serves as an arc shield.

The current transfer member 45 may also extend away from the movable contact part 14 only on one side, so as to thus leave free a large area of the upper side of the spring snap-action disc.

Figure 5:
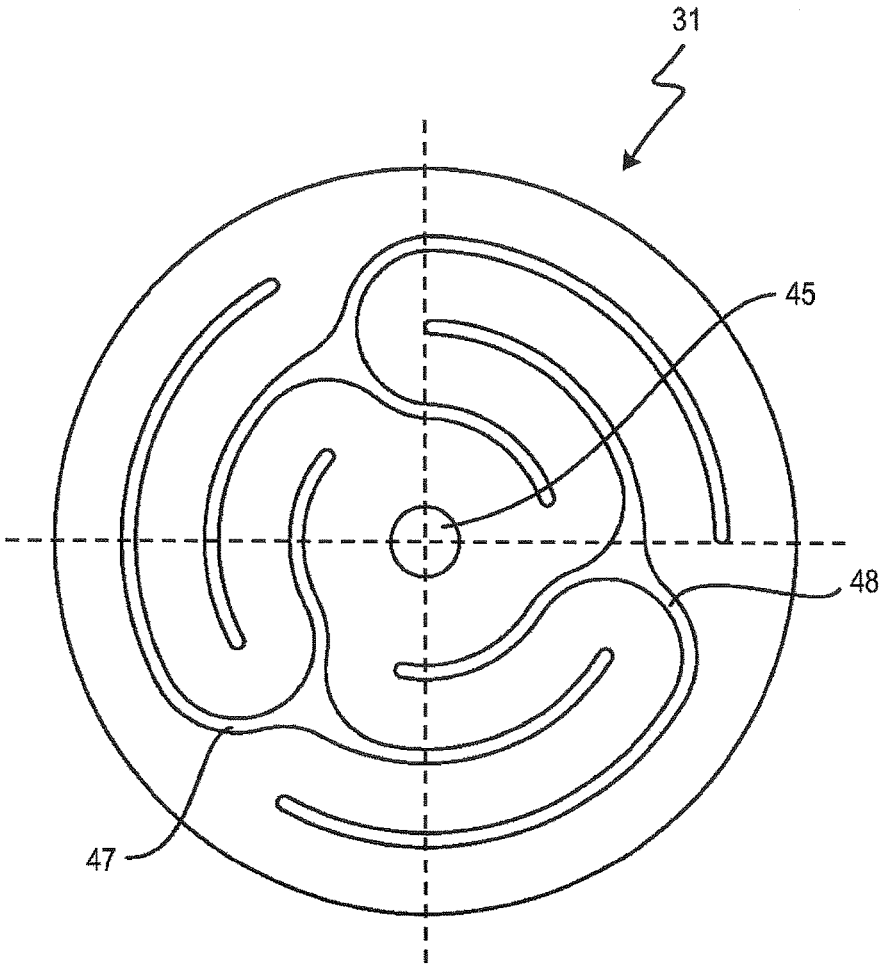
FIG. 5 shows a schematic view of the current transfer member from FIG. 2.

An embodiment for the current transfer member 31 from FIG. 2 is shown in a schematic plan view in FIG. 5. The current transfer member 31 is formed as a circular disc, in which curved, helical slots 46, 47 running radially outwardly are located. These slots 46, 47 reduce the spring effect of the current transfer member 31, such that, during switching, said member does not counteract the spring force of the bimetal snap-action disc and the spring force of the sprig snap-action disc 12.

Figure 6:
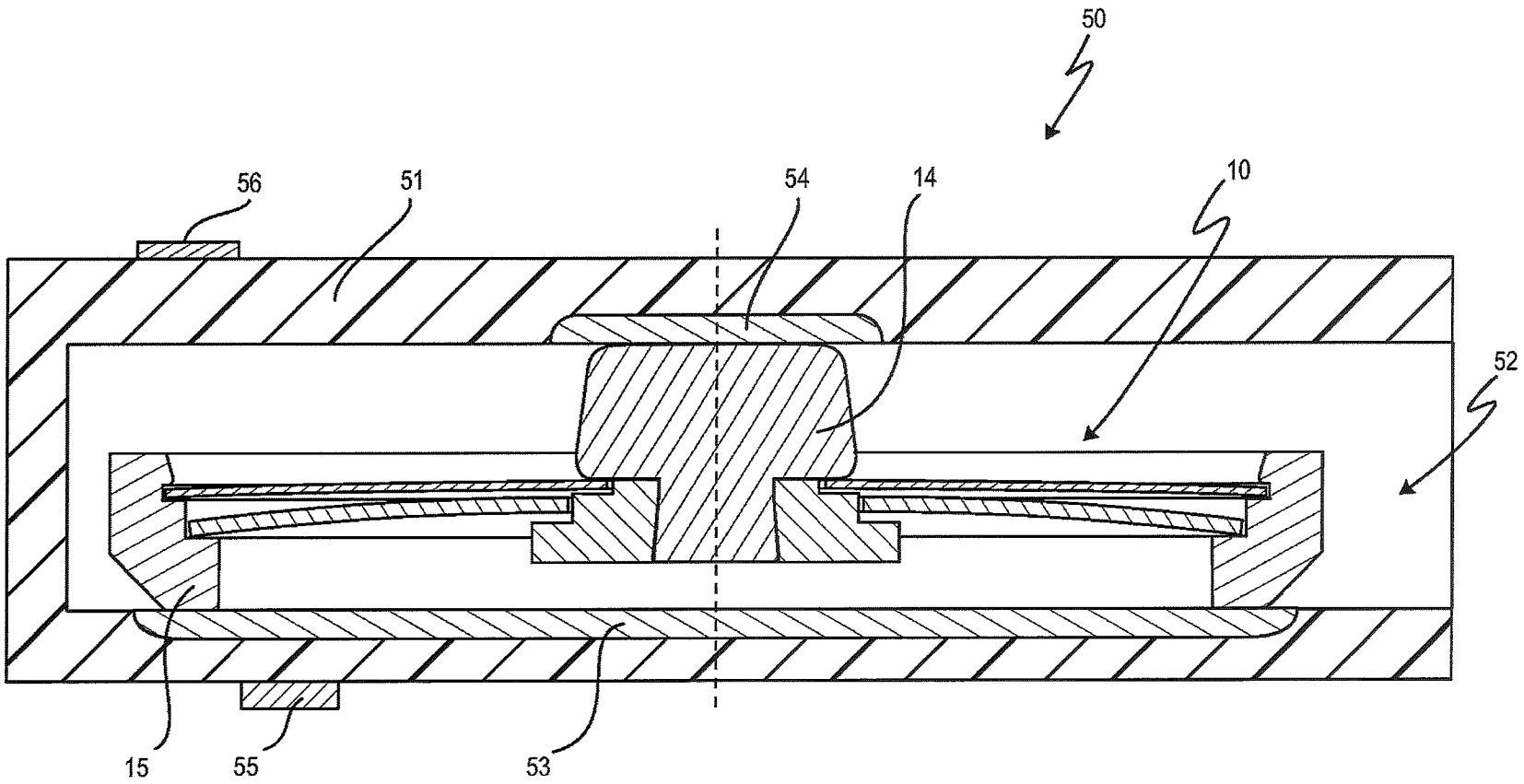
FIG. 6 shows a schematic sectional side view of a slip-in housing equipped with the switching mechanism from FIG. 1.

In FIG. 6, a slip-in housing 50 with walls 51 made of electrically insulating material is shown, said walls delimiting an insertion opening 52. The switching mechanism 10 from FIG. 1 is inserted into the insertion opening 52. Here, the frame 15 comes into contact with a base electrode 53, and the movable contact part 14 comes into contact with a cover electrode 54.

The base electrode 53 and cover electrode 54 are formed internally on the walls 51 and are connected to outer connections 55 and 56 respectively in a manner that is not shown.

The slip-in housing 50 can thus be used as a temperature-dependent switch, in which the switching mechanism 10 makes or opens an electrical connection between the outer connections 56, 57 in a temperature-dependent manner.

It is also possible for the slip-in housing 50 to be part of a device to be protected, in which a pocket forms the insertion opening 52. The outer connections may then lead to windings or components, between which the switching mechanism 10 makes or opens an electrical connection in a temperature-dependent manner.

Figure 7:
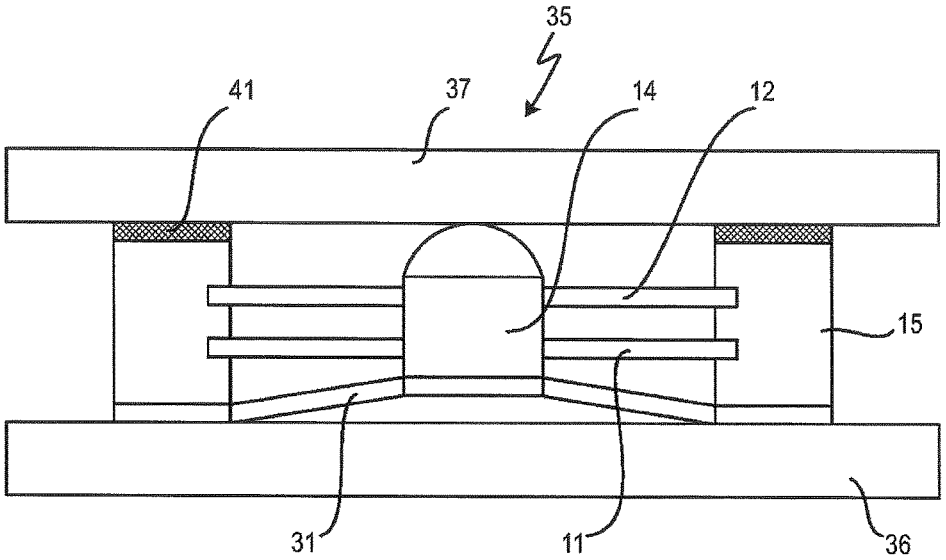
FIG. 7 shows a schematic functional diagram of the switch from FIG. 3.

FIG. 7 shows a schematic functional diagram of the switch 35 from FIG. 3. The switch 35 is closed, such that the operating current of the electrical device to be protected flows through the cover part 35 and the movable contact part 14, from here through the spring snap-action disc 12 and in parallel through the current transfer member 31, and then through the frame 15 and the lower part 36.

When the frame consists of electrically insulating material, the operating current consequently flows only through the cover part 35 and the movable contact part 14, from here through the current transfer member 31, and then through the lower part 36.

It is then possible to dispense with the insulating foil 41.

Figure 8:
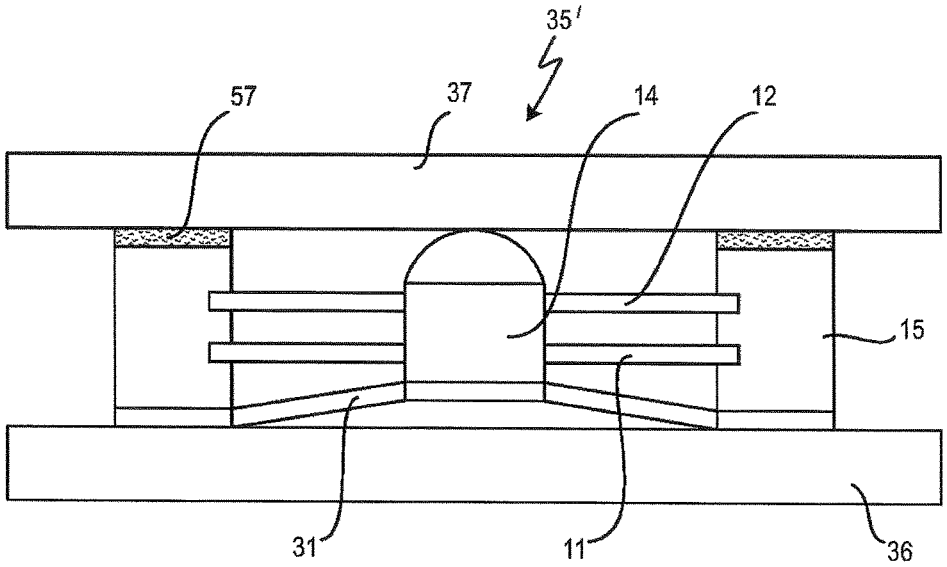
FIG. 8 shows an illustration similar to FIG. 7, but with a self-holding resistor.

In the case of the switch 35' from FIG. 8, the insulating foil 41 is exchanged for a resistive layer 57 arranged between the cover part 37 and frame 15. The frame 15 consists of electrically conductive material. In the closed state, the current flows as with the switch 35 from FIG. 7. If the switch 35' is open, however, a residual current flows through the cover part 37, resistive layer 57, frame 15 and lower part 36. Here, a sufficient resistive heat develops in the resistive layer 57 and prevents a cooling of the bimetal snap-action disc 11 below the snap-back temperature thereof, such that the switch 35' remains open.

Instead of a resistive layer 57, the frame 15 may also consist itself completely or in part of resistance material, in order to implement the self-holding function.

Figure 9:
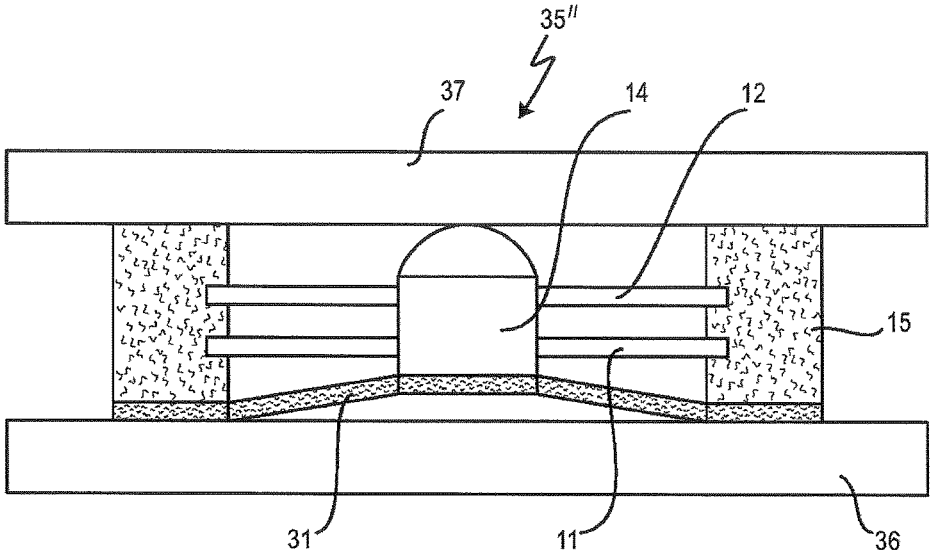
FIG. 9 shows an illustration similar to FIG. 7, but with a series resistor for current-dependent switching.

In FIG. 9, the switch 35 from FIG. 7 is modified such that the current transfer member 31 is formed as a series resistor. The frame 15 is electrically insulating, such that it is possible to dispense with the insulting foil 41.

In the closed state of the switch 35', the operating current flows through the cover part 37, movable contact part 14 and current transfer member 31 into the lower part 36. Here, the current transfer member 31 heats up as a result of the integrated series resistor in the event of an excessively high current flow, to such an extent that the developed resistive heat already opens the switch 35" before the heat developed by the device to be protected heats said switch to such an extent that the switch opens.

Figure 10:
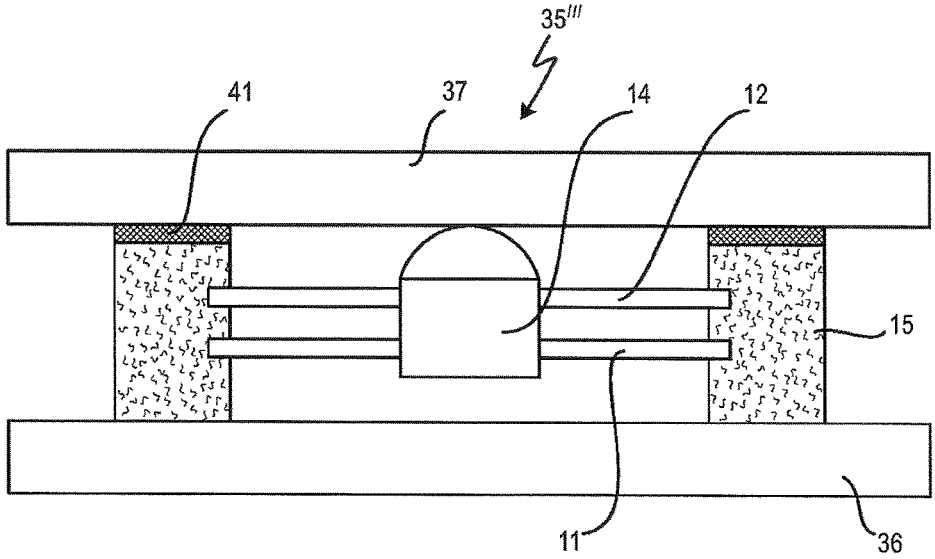
FIG. 10 shows an illustration similar to FIG. 8, but with series resistor for current-dependent switching and without current transfer member.

The switch 35 from FIG. 7 is shown in FIG. 10, but without current transfer member 31. As a result, the frame 15 is made of resistance material, such that it acts as a series resistor for current-dependent switching.

In the closed state of the switch 35''', the operating current flows through the cover part 37, movable contact part 14, spring snap-action disc 12 and frame 15 into the lower part 36. Here, the frame 15 heats up due to the integrated series resistor in the event of excessively high current flow to such an extent that the developed resistive heat already opens the switch 35" before the heat developed by the device to be protected heats up said switch to such an extent that the switch opens.

Figure 11:
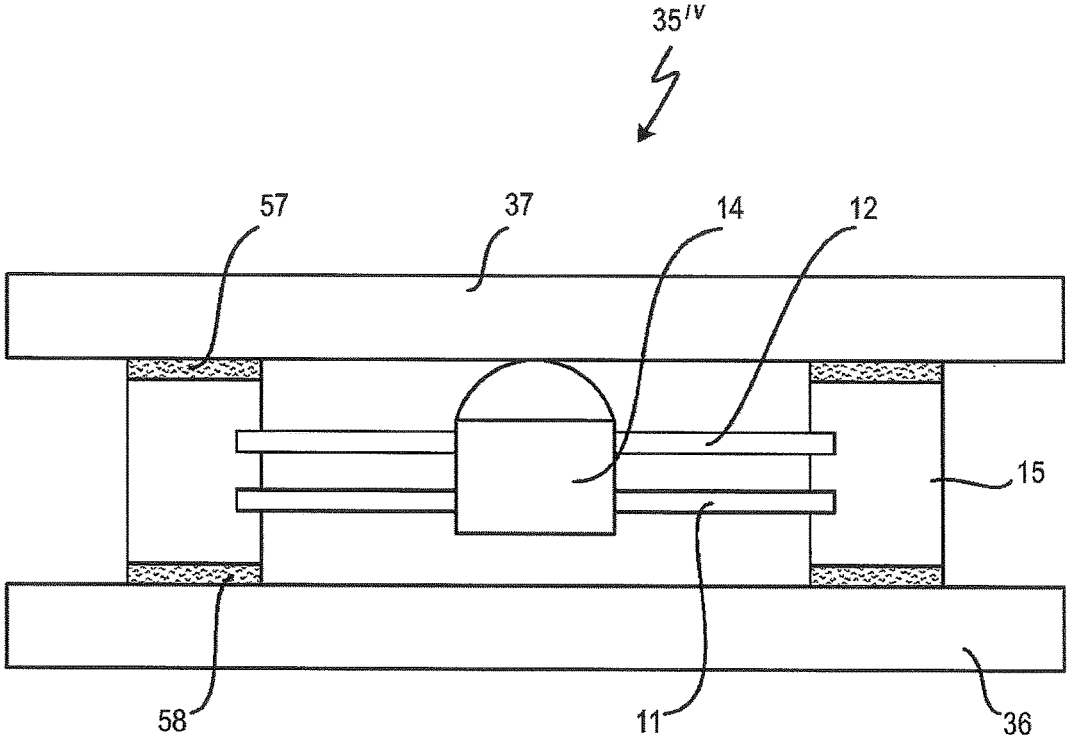
FIG. 11 shows an illustration similar to FIG. 10, without series resistor, but with self-holding resistor.

FIG. 11 shows the switch 35''' from FIG. 10, wherein the frame 15 is electrically conductive here. Instead of the insulating foil 41, a resistive layer 57 is provided, as is the case with the switch 35' from FIG. 8.

In the closed state of the switch $35^{IV}$, the operating current flows through the cover part 37, movable contact part 14, spring snap-action disc 12 and frame 15 into the lower part 36.

When the switch $35^{IV}$ opens, a residual current flows through the cover part 37, resistive layer 57, frame 15 and lower part 36. Here, a sufficient resistive heat develops in the resistive layer 57 and prevents the bimetal snap-action disc 11 from cooling below the snap-back temperature thereof, such that the switch 35' remains open.

Instead of a resistive layer 57, the frame 15 here too may consist itself completely or partially of resistance material in order to implement the self-holding function.

In addition, the switch $35^{IV}$ may also comprise a resistive layer 58 between the frame 15 and lower part 36, said layer acting as a series resistor for current-dependent switching, because it is arranged in the circuit of the operating current when the switch $35^{IV}$ is closed and heats the switch to such an extent in the event of an excessively high current flow that the switch $35^{IV}$ opens.

The resistance value of the resistive layer 57 is much greater here than that of the resistive layer 58.

Therefore, what is claimed is:

1. A temperature-dependent switching mechanism comprising a ring-shaped annular frame that does not have a closed bottom, a bimetal snap-action disc, a movable contact member and a spring snap-action disc carrying said movable contact member, said bimetal snap-action disc and said spring snap-action disc being captively held in said frame; and wherein the bimetal snap-action disc has a low-temperature position and a high-temperature position, a first peripheral shoulder being arranged internally in the frame, on which first peripheral shoulder a rim of the bimetal snap-action disc is supported during the transition from its high-temperature position into its low-temperature position.

2. The switching mechanism of claim 1, wherein the annular frame comprises an upper ring surface.

3. The switching mechanism of claim 1, wherein the annular frame comprises a lower ring surface.

4. The switching mechanism of claim 1, wherein the annular frame comprises an upper ring surface and a lower ring surface arranged parallel to one another and interconnected by a peripheral cylinder surface running transversely to the upper and lower ring surfaces.

5. The switching mechanism of claim 4, wherein a conical transition surface is arranged between the cylinder surface and the lower ring surface.

6. The switching mechanism of claim 1, wherein the movable contact member is a movable contact part, which is arranged between the bimetal snap-action disc and the spring snap-action disc.

7. The switching mechanism of claim 1, wherein the bimetal snap-action disc is fixed captively with play to the movable contact member.

8. The switching mechanism of claim 1, wherein the spring snap-action disc is fixed captively to the movable contact member.

9. The switching mechanism of claim 1, wherein a second peripheral shoulder is arranged inwardly in the frame, on which second peripheral shoulder a rim of said spring snap-action disc is supported.

10. The switching mechanism of claim 9, wherein the second peripheral shoulder is arranged in a groove running peripherally internally in the frame, in which groove said rim of said spring snap-action disc is arranged.

11. The switching mechanism of claim 10, wherein said rim of said spring snap-action disc is latched into said groove.

12. The switching mechanism of claim 9, wherein said rim of said spring snap-action disc is held in place by a protrusion extending over said rim of the spring snap-action disc, and formed only after said rim of said spring snap-action disc has been placed on the second peripheral shoulder.

13. The switching mechanism of claim 1, which comprises a current transfer member connected to the movable contact member.

14. The switching mechanism of claim 13, wherein the current transfer member is connected to the annular frame.

15. The switching mechanism of claim 13, wherein the annular frame comprises an upper ring surface and a lower ring surface, the current transfer member being arranged between the upper and lower ring surfaces.

16. The switching mechanism of claim 13, wherein the annular frame comprises an upper ring surface and a lower ring surface, the current transfer member being arranged with its rim above the upper ring surface.

17. The switching mechanism of claim 13, wherein the annular frame comprises an upper ring surface and a lower ring surface, the current transfer member being arranged with its rim below the lower ring surface.

18. The switching mechanism of claim 1, wherein the annular frame comprises electrically conductive material.

19. The switching mechanism of claim 1, wherein the annular frame comprises electrically insulating material.

20. The switching mechanism of claim 1, wherein the annular frame comprises electrical resistance material.

21. The switching mechanism of claim 1, wherein the annular frame comprises at least one resistive layer.

* * * * *